US006042281A

United States Patent [19]

Ohtani

[11] Patent Number: 6,042,281

[45] Date of Patent: Mar. 28, 2000

[54] PRINTING APPARATUS

[75] Inventor: Katsuhiko Ohtani, Tokyo, Japan

[73] Assignee: Mutoh Industries, Ltd., Tokyo, Japan

[21] Appl. No.: 09/301,166

[22] Filed: Apr. 28, 1999

[30] Foreign Application Priority Data

Apr. 30, 1998 [JP] Japan ..... 10-120895

[51] Int. Cl.[7] ..... B41J 21/16

[52] U.S. Cl. ..... 400/279; 400/283

[58] Field of Search ..... 400/279, 283

[56] References Cited

U.S. PATENT DOCUMENTS

| | | | |
|---|---|---|---|
| 4,709,247 | 11/1987 | Piatt et al. | 346/140 |
| 4,709,248 | 11/1987 | Piatt et al. | 346/140 |
| 5,411,340 | 5/1995 | Elgee | 400/279 |
| 5,748,206 | 5/1998 | Yamane | 347/47 |

FOREIGN PATENT DOCUMENTS

| | | | |
|---|---|---|---|
| 9254480 | 9/1997 | Japan | B41J 19/18 |

*Primary Examiner*—John S. Hilten
*Assistant Examiner*—Charles H. Nolan, Jr.
*Attorney, Agent, or Firm*—Webb Ziesenheim Logsdon Orkin & Hanson, P.C.

[57] ABSTRACT

The present invention realizes excellent controllability of print position even when a print head is driven at accelerating or decelerating speed while keeping advantages of fine and high resolution printing quality. A position information signal generator 9 in an ink-jet plotter comprises an interpolating circuit 12 which generates a first position information signal based on an A-phase output of A-phase and B-phase outputs from a sensor 5, an edge detector 13 which generates a second position information signal by multiplying the A-phase and B-phase outputs by four, a selector which selects the outputs from the interpolating circuit 12 and the edge detector 13, and a select control circuit 15 which switches the selector 14. The interpolating circuit 12 takes only the A-phase output of the A-phase and B-phase outputs to detect the edges in the A-phase output, and divide intervals between the detected edges based on resolution indicated by a resolution indicating terminal 11, then interpolates pulses corresponding to the indicated resolution into the pulse intervals to obtain the first position information signal. The edge detector 13 detects rising edges and falling edges in the A-phase and B-phase outputs, and synthesizes the detected edges to obtain the second position information signal. The select control circuit 15 detects the head speed or acceleration of a print head 2 based on information from the interpolating circuit 12, and controls the selector 14 based on the detection result.

8 Claims, 9 Drawing Sheets

PRINTING APPARATUS

BACKGROUND OF THE INVENTION

1. Field of the Invention

The present invention relates to a printing apparatus such as an ink-jet plotter having a linear encoder which detects print head position and controls printing position.

2. Description of the Related Art

A printing apparatus like an ink-jet plotter having a movable print head comprises a linear encoder which detects position of the print head. In such printing apparatus, the print head is driven along a guide shaft. A position information signal indicating position of such movable print head is generated based on output signals of the linear encoder. The print head is driven based on the position information signal and image data. The linear encoder comprises a scale (timing fence) and a sensor. The scale is disposed so as to be in parallel to the guide shaft. The sensor is coupled with the print head, and measures graduation on the scale while being driven along the scale.

The linear encoder outputs an A-phase output signal and a B-phase output signal as shown in FIG. 10. The phase difference between the A-phase output and the B-phase output is 90 degrees. A position information signal for determining pitch of printing position is generated based on the A-phase and B-phase outputs from the linear encoder. In a case where a plotter is designed for printing images on a sheet in relatively large size such as A1 or A0, the plotter requires a longer scale. However, it is difficult to obtain high resolution from such a long scale. In order to obtain higher printing resolution than the actual scale resolution, a position information signal with high resolution has to be formed from the A-phase or B-phase outputs. For example, as shown in FIG. 10, a position information signal whose frequency is four times higher than that of the A-phase and B-phase outputs may be formed by detecting the leading and trailing edges of the A-phase and B-phase outputs. With the position information signal, the resultant resolution for printing will be 720 dpi (dots per inch) while the scale resolution is 180 dpi.

Such a conventional method of controlling printing position in an ink-jet plotter, however, has problems of that (i) increased pulses in the print position information signal may be inconstant when encoder's error occurs as shown in FIG. 11, and this causes low image quality; and (ii) the selectable resolution is limited to few resolution sets, and the maximum resolution is only four times higher than the scale resolution.

In consideration of the above, the inventor of the present invention has proposed an improved printing apparatus, in Laid-open Japanese Patent Application (kokai) No. 9-254480, which provides arbitrary selectable printing resolutions while controlling the print head with high resolution. In the printing apparatus, it measures intervals between edges of the outputs from the encoder, divide the measured interval data by a predetermined number, and generate pulses in each divided time periods. Thus, the higher resolution is realized with the generated pulses for printing position control.

SUMMARY OF THE INVENTION

It is an object of the present invention to provide a printing apparatus which is improved from the above described conventional printing apparatus in order to realize precise printing position control even if the print head is driven at accelerating or decelerating speed, while keeping its advantageous fine and high resolution printing quality.

According to a first aspect of the present invention, a printing apparatus comprises:

a print head which is driven along a guide;

a linear encoder comprising a scale which is in parallel to the guide, and a sensor which is driven along the scale together with the print head to read the scale and outputs a plurality of encoder output signals having different phases;

position information signal generating means for generating a print position information signal indicating position of the print head by processing the encoder output signals; and head drive means for driving the print head based on the position information signal output from the position information signal generating means and image data, wherein the position information signal generating means comprises:

interpolating means for generating a reference pulse signal by detecting pulse edges in at least one of the encoder output signals from the linear encoder, for obtaining interval data by measuring time periods between pulses in the reference pulse signal and obtaining divided time data by dividing the interval data by a predetermined number, for generating a correction signal at each end of the time periods represented by the divided time data, and for outputting a first position information signal based on the correction signal and the reference pulse signal;

an edge detector for outputting a second position information signal which is obtained by detecting pulse edges in the plurality of encoder output signals, generating pulses in response to the edge detection, and synthesizing the detection pulses;

selecting means for selecting any one of the first position information signal from the interpolating means and the second position information signal from the edge detector; and select control means for controlling the selecting means to select the first position information signal from the interpolating means as a print position information signal when the print head is driven at a speed which is higher than a predetermined speed and to select the second position information signal from the edge detector as the print position information signal when the print head is driven at a speed which is lower than the predetermined speed.

According to the above structure, high resolution is selected when the print head is driven at a high speed wherein overflows are unlikely to occur while the interpolating means measures the pulse intervals. In such a situation, the arbitrary selectable first position information signal generated by the interpolating means is selected as the print position information signal. The second position information signal generated by the edge detector is selected as the print position information signal when the print head is driven at a low speed wherein the overflows are likely to occur during the pulse interval measuring. As a result, stable position control is realized even if the head speed varies. A threshold head speed for switching the position information signal should be a speed which causes the overflows while the interpolating means measures the pulse intervals, with some margins.

According to a second aspect of the present invention, a printing apparatus comprises:

a print head which is driven along a guide;

a linear encoder comprising a scale which is in parallel to the guide, and a sensor which is driven along the scale together with the print head to read the scale and outputs a plurality of encoder output signals having different phases;

position information signal generating means for generating a print position information signal indicating position of the print head by processing the encoder output signals; and head drive means for driving the print head based on the position information signal output from the position information signal generating means and image data, wherein the position information signal generating means comprises:

interpolating means for generating a reference pulse signal by detecting pulse edges in at least one of the encoder output signals output from the linear encoder, for obtaining interval data by measuring time periods between pulses in the reference pulse signal and obtaining divided time data by dividing the interval data by a predetermined number, for generating a correction signal at each end of the time periods represented by the divided time data, and for outputting a first position information signal based on the correction signal and the reference pulse signal;

an edge detector for outputting a second position information signal which is obtained by detecting pulse edges in the plurality of encoder output signals, generating pulses in response to the edge detection, and synthesizing the detection pulses;

selecting means for selecting any one of the first position information signal from the interpolating means and the second position information signal from the edge detector; and select control means for controlling the selecting means to select the first position information signal from the interpolating means as the print position information signal when an absolute value of acceleration of the print head is equal to or smaller than a predetermined acceleration, and to select the second position information signal from the edge detector as the print position information signal when the absolute value of acceleration of the print head is larger than a predetermined acceleration.

Since output timing of the first position information signal generated by the interpolating means depends on the divided time data obtained by dividing the pulse intervals of the reference pulse signal measured in the past, it is unable to interpolate the position information signal into the pulse intervals in the reference pulse signal constantly in a case where the head speed (accelerating or decelerating) when measuring the interval data differs from the head speed when generating the first position information signal. Moreover, if the head speed when measuring the interval data differs greatly from the head speed during interpolation, pulses to be interpolated may lack or extra pulses may be interpolated. Such problems do not occur in the output of the edge detector because the output varies in accordance with the current head speed. In the present invention, the first position information signal generated by the interpolating means is selected as the print position signal only when an absolute value of the head acceleration is equal to or smaller than a predetermined acceleration, and the second position information signal generated by the edge detector is selected as the print position information signal in the other case. Thus, the position of the print head is controlled preciously even when the print head is driven at an accelerating or decelerating speed.

In the present invention, it is preferred that the selecting means is controlled to select the first position signal as the print position signal when each of the differences between successive interval data segments is smaller than the divided time data and to select the second position information signal as the print position information signal when each of the differences between successive interval data segments is equal to or larger than the divided time data. According to this structure, the problems of the lack of the pulses or extra pulses during interpolation are resolved even when the print head is driven at an accelerating or decelerating speed.

Generally, the head speed varies acceleration, constant, and deceleration in order, and the print head prints during the constant speed range in actual printing operation. Therefore, the first position information signal having high resolution may be selected when the print head is driven at a constant speed, and the second position information signal having low resolution may be selected when the print head is driven at an accelerating or decelerating speed.

While the print head is driven at an accelerating or decelerating speed, that is, during non-printing periods, the print position information signal is supplied to the counter to merely count it. Even when such acceleration or deceleration range, problems do not occur if the correct number of pulses are interpolated into the pulse intervals in the reference pulse signal. To keep the number of the pulses to be interpolated correct, the first position information signal is selected as the print position information signal when each of the differences between successive interval data segments is smaller than the divided time data, and the second position information signal is selected as the print position information signal in the other cases. Thus, the high resolution printing is realized during non-printing periods.

DETAILED DESCRIPTION OF THE PREFERRED EMBODIMENT

An embodiment of the present invention will now be described with reference to accompanying drawings.

Figure 1:
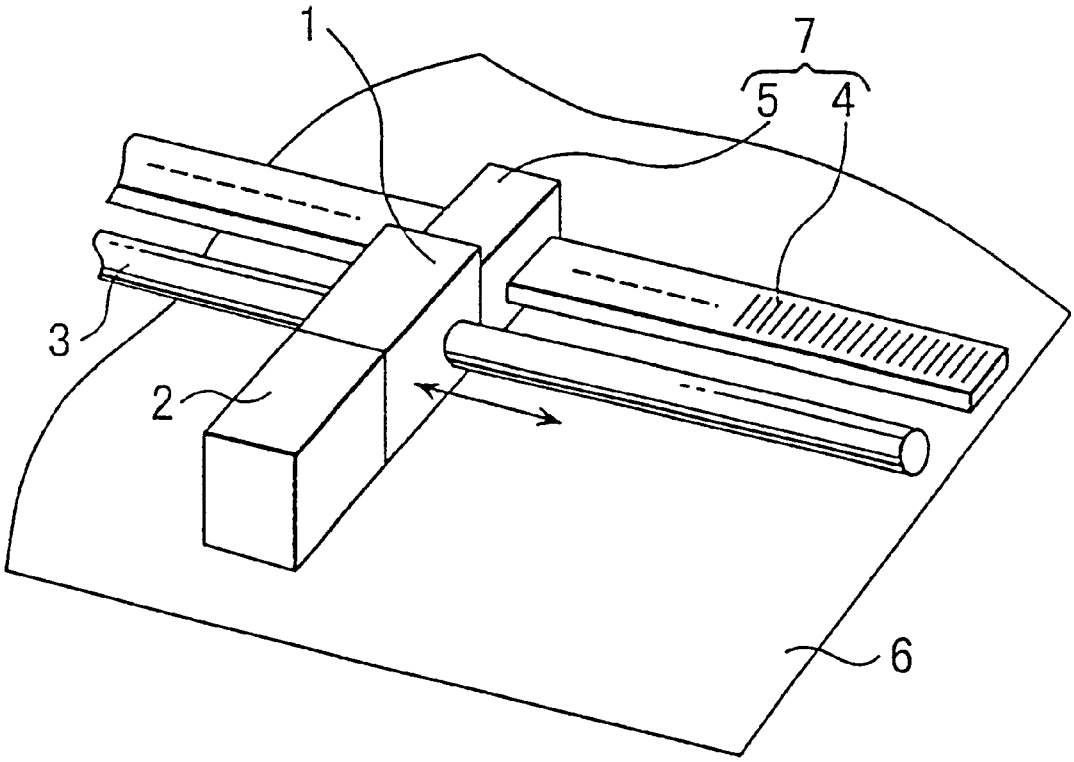
FIG. 1 is a view showing essential components of an ink-jet plotter according to one embodiment of the present invention.

FIG. 1 shows essential components of an ink-jet plotter according to one embodiment of the present invention. A carriage 1 is driven sideways along a guide shaft 3. A print head unit 2 comprises ink-jet nozzles which are disposed with a predetermined arrangement for raster scanning, and is attached to the carriage 1 so as to the nozzles face a printing sheet 6. A scale 4 is disposed so as to be in parallel to the guide shaft 3. A sensor 5 which is attached to the carriage 1 moves together with the carriage 1 and reads the scale 4. A combination of the scale 4 and the sensor 5 acts as a linear encoder 7. The linear encoder 7 may adopt any one of magnetic sensing, optical sensing, and electrostatic sensing.

Figure 2:
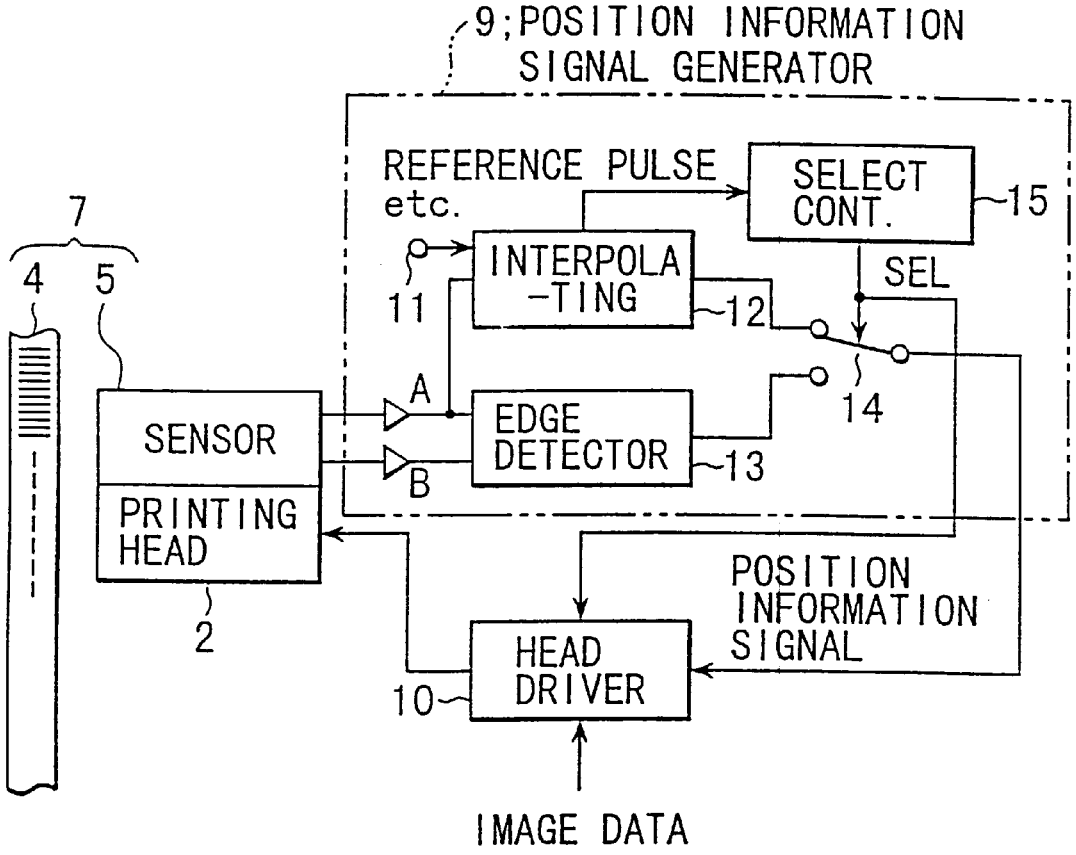
FIG. 2 is a block diagram showing the structure of a head unit driving section according to the embodiment.

FIG. 2 shows the structure of components for driving the print head unit 2 utilizing outputs of the encoder 7. Note that a scanning control circuit for the print head unit 2 is not shown. A position information signal generator 9 generates a position information signal based on an A-phase output signal and a B-phase output signal from the encoder 7 and supplies the generated position information signal to a head driver 10. The position information signal is for determining printing positions with preciseness finer than one pitch of the scale 4. The head driver 10 receives the position information signal together with image data, and controls ink ejection at a position defined by the position information signal.

The position signal generator 9 comprises: an interpolating circuit 12 for generating a first position information signal based on the A-phase output from the sensor 5; an edge detector 13 for generating a second position information signal, based on both the A-phase and B-phase outputs, whose pulse frequency is four times higher than that of the A-phase and B-phase outputs; a selector 14 for selecting one of the outputs from the interpolating circuit 12 and the edge detector 13; and a select control circuit 15 for controlling the selector 14. The interpolating circuit 12 receives only the A-phase output of the A-phase and B-phase outputs, detects the edges of the supplied A-phase output, and generates pulses upon the detection. Further, the interpolating circuit 12 measures intervals between the detected edges, divides the measured intervals based on resolution instructed via a resolution indicating terminal 11, and interpolates (adds) pulses at timings corresponding to the divided intervals, then the resultant signal is output as the first position information signal whose pulse cycle corresponds to the instructed resolution. The edge detector 13 detects rising (leading) edges and falling (trailing) edges in the A-phase and B-phase outputs, and generates pulses upon detection of the edges, then generates the second position information signal by synthesizing the pulses corresponding to the detected edges. The select control circuit 15 detects the head speed or acceleration of the print head 2 based on information from the interpolating circuit 12, and switches the selector 14 in accordance with a result of the detection.

Figure 3:
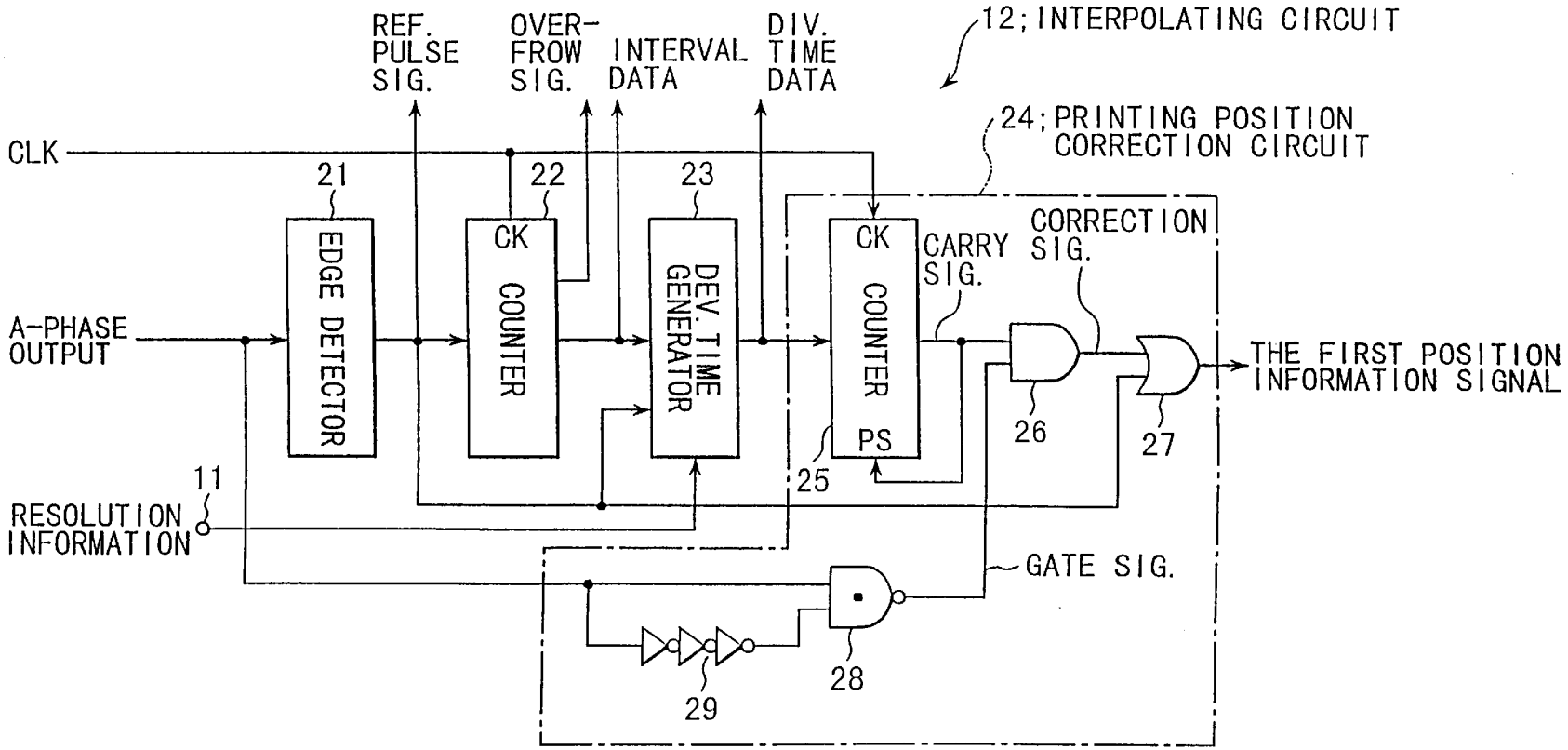
FIG. 3 is a block diagram showing the structure of an interpolating circuit according to the embodiment.

FIG. 3 shows the structure of the interpolating circuit 12 in detail. As illustrated, the interpolating circuit 12 comprises: a rising edge detector 21; a first counter 22; a divided time data generator 23; and a printing position correction circuit 24. The rising edge detector 21 detects rising edges of repetitive pulses included in the A-phase output from the linear encoder 7, and outputs a reference pulse signal including pulses at timings of the detected rising edges. The first counter 22 measures pulse intervals of the reference pulse signal output from the rising edge detector 21 sequentially and outputs the interval data representing the measured intervals. The divided time data generator 23 sequentially samples (receives) the interval data output from the first counter 22 in response to the reference pulse signal and generates divided time data by dividing the interval data by $2^n$ (where n is an arbitrary integral number) indicated by a signal supplied via the resolution indicating terminal 11. The printing position correction circuit 24 receives the divided time data generated by the divided time data generator 23 and repeatedly measures time periods represented by each divided time data in each pulse cycle of the reference pulse signal. Each time the measurement is completed, the printing position correction circuit 24 generates a correction signal, and generates a printing position information signal by synthesizing (combining) the correction signal and the reference pulse signal from the rising edge detector 21 on a time axis, then outputs the printing position information signal.

The first counter 22 is reset by the reference pulse signal from the rising edge detector 21 and counts a clock signals CLK, and this resetting and counting operations are performed repeatedly. The first counter 22 sequentially outputs the counted peak values in each cycle as data indicating measured time period between the rising edges in the A-phase output. The divided time data generator 23 also defines resolution of printing position with high resolution. To obtain high resolution, the divided time data generator 23 interpolates (adds) pulses to the reference pulse signal from the rising edge detector 21 so that resultant intervals between adjacent pulses will be constant. That is, the divided time data generator 23 samples the digital interval data from the first counter 22 in response to the output of the rising edge detector 21, and shifts the sampled data n bits to LSB (Least Significant Bit) side to obtain the divided time data representing a value of the interval data divided by $2^n$. In other words, the divided time data generator 23 generates the divided time data in accordance with n which is defined by the instruction via the resolution instructing terminal 11 for bit shift so that the generated divided time data contains segments each of which represents divided time period. The interval to be divided was measured during the preceding cycle of the reference pulse signal, and the measured time period is divided by 4, 8, 16, or the like in accordance with the defined bit shift n.

The printing position correction circuit 24 comprises a second counter 25 for measuring time periods represented by the divided time data generated by the divided time data generator 23. For example, the counter 25 receives the divided time data from the divided time data generator 23 and sets the received data to itself as an initial count value, and decrements the count value in accordance with the clock signal CLK. When the counted value becomes 0, the counter 25 outputs a carry (borrow) signal indicating end of counting. Then, the counter 25 sets next divided time data supplied from the divided time data generator 23 to itself in response to the carry signal and restarts the counting. Thus, the time measuring operation is performed repeatedly.

The carry signal of the counter 25 becomes the correction signal via an AND gate 26. A gate signal is also input to the AND gate 26. The gate signal is provided for eliminating last signal component (carry signal) in each cycle of the reference pulse signal, that is, for eliminating signal components overlapping with the pulses in the reference pulse signal when the print head is driven at constant speed. An inversion delay circuit 29 comprises odd numbered inverter(s) to invert and delay the A-phase output from the encoder 7 for period $\tau$. The A-phase output from the encoder 7 and the inverted-and-delayed A-phase signal from the inversion delay circuit 29 are input to a NAND gate 28, and the NAND gate 28 outputs the gate signal.

And OR gate 27 is provided for obtaining the first position information signal by synthesizing (ORing) the correction signal from the AND gate 26 and the reference pulse signal from the rising edge detector 21.

Figure 4:
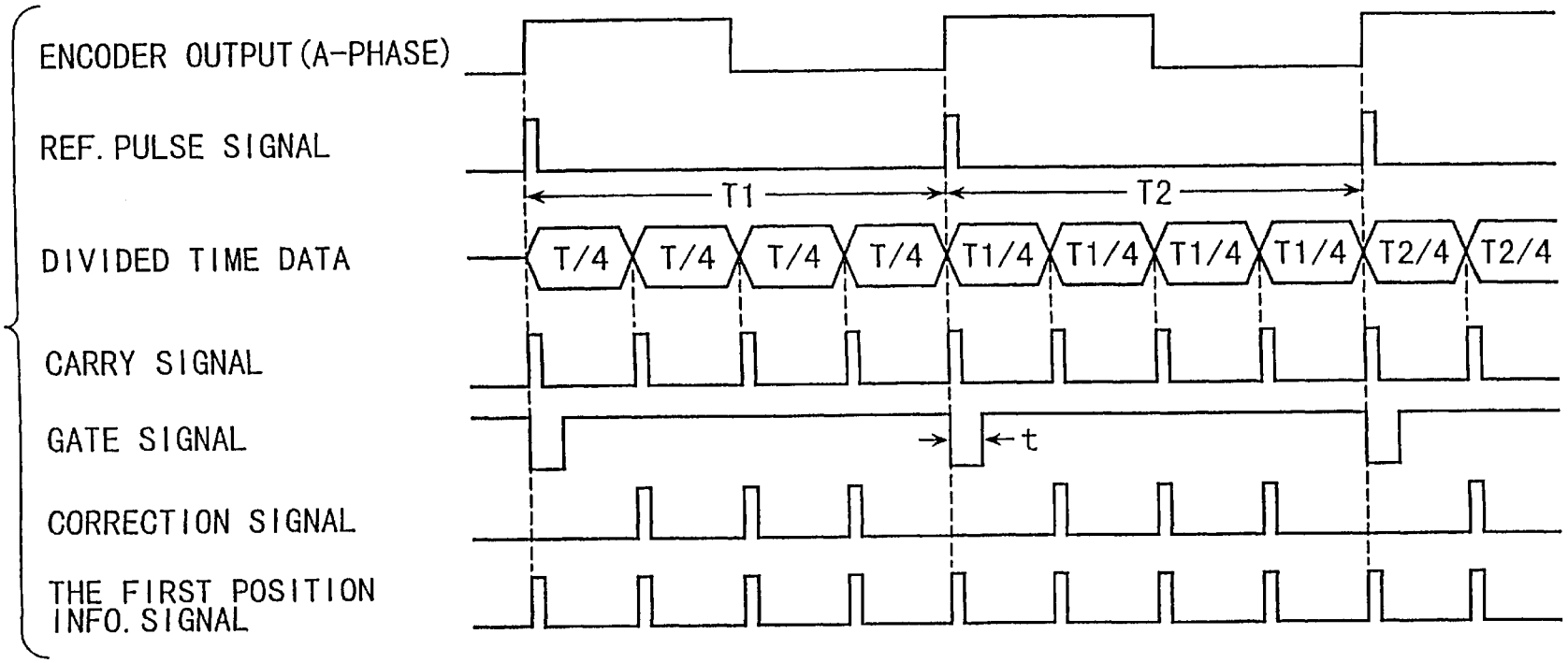
FIG. 4 is a timing chart for explaining operation of the interpolating circuit.

FIG. 4 shows an operation timing of the position information signal generator 9 having the above structure. The rising edge detector 21 detects rising edges of the A-phase output and outputs the reference pulse signal corresponding to the detected edges at every cycle of the A-phase output as shown in FIG. 4. The first counter 22 measures intervals between the sequential pulses of the reference pulse signal and outputs the interval data representing the measured time periods T1, T2, . . . If the print head 2 is driven at constant speed, intervals T1, T2, . . . represented by the interval data are the same length with each other. The divided time data generator 23 samples the interval data in response to the output (reference pulse signal) of the rising edge detector 21. The divided time data generator 23 uses the sampled interval data for generate the time divided data of the next cycle of the reference pulse signal. If a given instruction supplied via the resolution instructing terminal 11 indicates that the number of division is 4 (n=2), 4-divided time data representing T1/4, T2/4, . . . are prepared as shown in FIG. 4. The exemplified number of division in the interpolating circuit 12 is 4 for explanatory purpose, however, the number of division may be, for example, 8, 16, 32, . . . each of which is larger than the number of division in the edge detector 13.

After performing such repetitive measuring sequences by the second counter 25, a carry signal whose frequency is 4 times higher than that of the reference pulse signal is obtained as shown in FIG. 4. The NAND gate 28 generates a gate signal having negative pulses whose pulse width is $\tau$ at timings of the rising edges of the A-phase output as shown in FIG. 4. The AND gate 26 is closed by the gate signal, and eliminates pulses in the carry signal which overlap with the pulses in the reference pulse signal. As a result, the correction signal as shown in FIG. 4 is obtained.

If the head speed of the print head 2 does not vary, the eliminating operation by the NAND gate 28 is unnecessary, that is, the whole carry signal may be used as the correction signal, because the last carry pulse in each cycle overlap with the pulse in the reference pulse signal as shown in FIG. 4. However, the last carry pulses may not coincide with the pulses of the reference pulse signal when the head speed is varying, because the internal data obtained in a cycle is used to obtain the divided time data for the next cycle of the sequential pulse (A-phase signal) output from the encoder 7 in this embodiment. Therefore, time gaps between the last carry pulses and the pulses in the reference pulse signal may appear. Preparation of the correction signal by NAND gate 28 is necessary for compensate the time gaps between the last carry pulses and the pulses in the reference pulse signal. The OR gate 27 synthesizes (ORs) the correction signal shown in FIG. 4 and the reference pulse signal shown in FIG. 4 on a time axis, thus a corrected position information signal shown in FIG. 4 is generated.

Since the interpolating circuit 12 generates high resolution position information signal using only the A-phase output from the encoder 7, high printing quality with resolution which is higher than that of the scale is realized even if the encoder 7 has scanning errors. In the above explanation, the divided time data is obtained by dividing the interval data of the preceding cycle. However, the divided time data may be prepared with the interval data of two cycles before. This method will work well without any significant problems if a time difference between the cycles is not too long. Moreover, arbitrary resolution is selectable. For example, high quality printing with enhanced resolution such as 720 dpi, 1440 dpi or 2880 dpi is available while the resolution of the scale is 180 dpi. That is, print resolution will be four times higher than the scale resolution or more. Furthermore, such high resolution printing is realized without enhancing the scale resolution. Therefore, high quality printing will be realized without additional costs even if a printing apparatus requires a longer scale.

Figure 5:
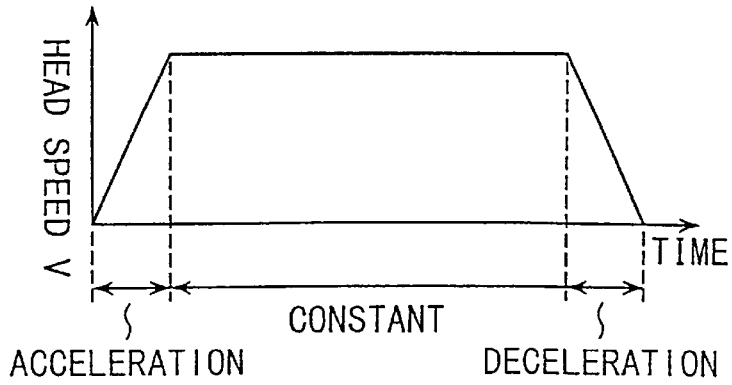
FIG. 5 is a graph speed of a print head unit according to the embodiment.

As shown in FIG. 5, head speed of the print head unit 2 varies in order of acceleration, constant, and deceleration. Since the pulse cycle of the reference pulse signal varies greatly during the acceleration period and deceleration period, interpolation errors are likely to occur in the interpolating circuit 12. Moreover, count values of the first counter 22 may overflow when the head speed of the print head unit 2 is low. As a result, interval data may be measured incorrectly. In order to obtain certain data, a printing operation based on the position information signal from the interpolating circuit 12 should be performed during constant head speed range. During a non-printing period, the print head 2 is controlled based on the position information signal from the edge detector 13 because the counter merely counts the printing position information signal. If it is able to interpolate the correct number of pulses into the pulse intervals of the reference pulse signal, the print head 2 is controllable based on the position information signal from the interpolating circuit 12 even when the print head 2 is driven at accelerating or decelerating speed.

Figure 6:
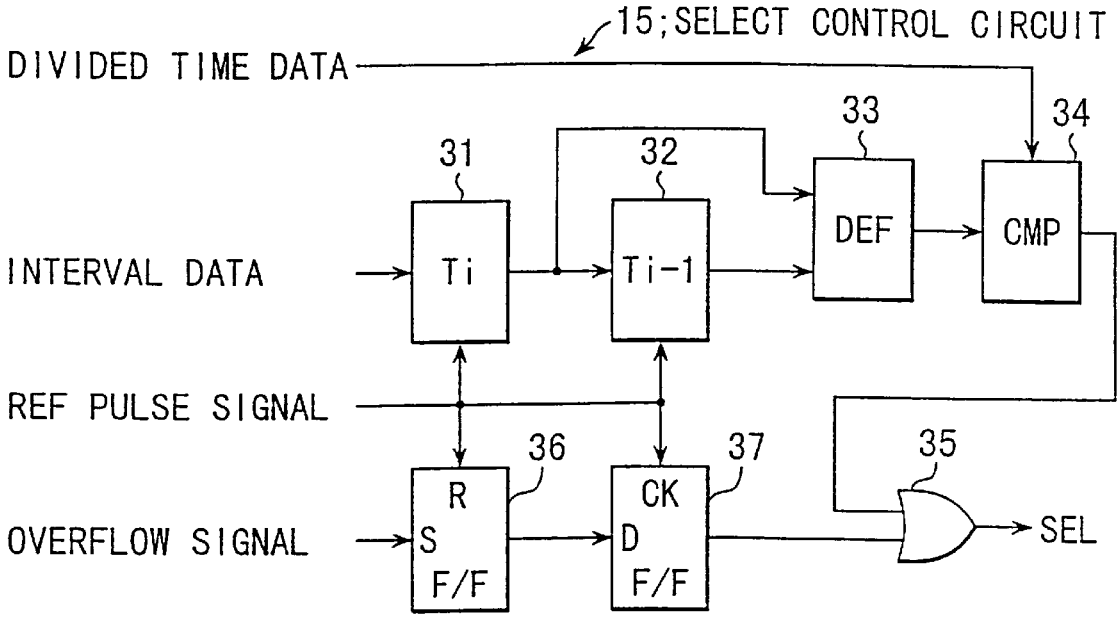
FIG. 6 is a block diagram showing the structure of a select control circuit according embodiment.
Figure 7:
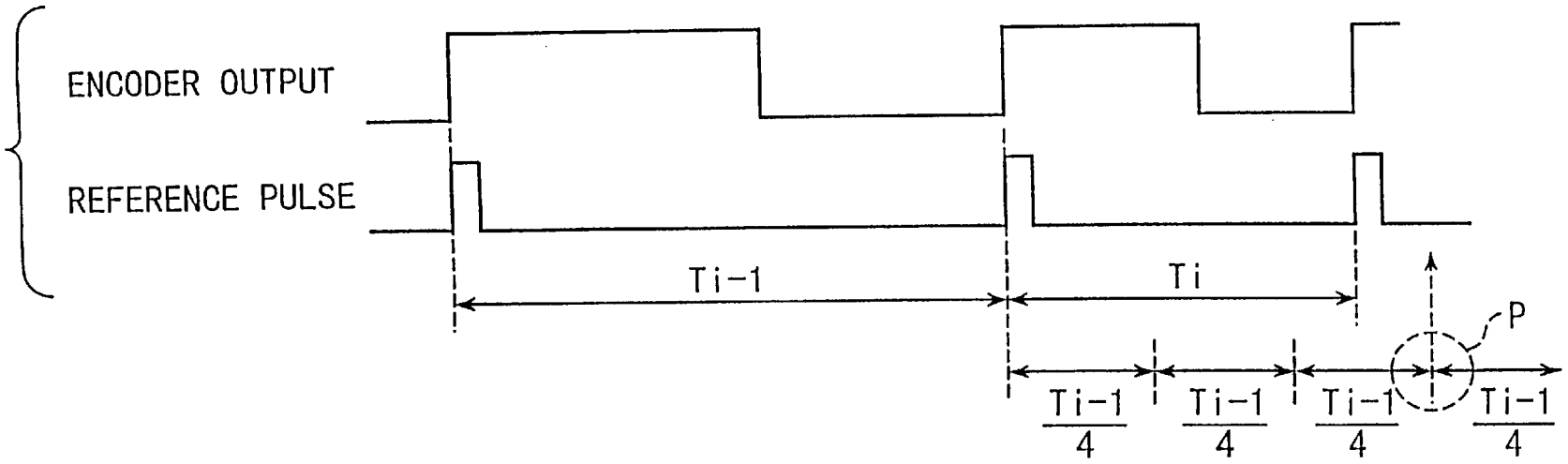
FIG. 7 is a timing chart explaining operation of the interpolating circuit during an acceleration period of the head speed of the print head according to the embodiment.

FIG. 6 shows an example of the structure of the select control circuit 15 which allows the above described operations. Registers 31 and 32 sequentially stores the interval data supplied from the first counter 22. The registers 31 and 32 output interval data measured in a cycle Ti and interval data measured in a cycle Ti−1 respectively. The cycle Ti is a cycle just before the current cycle, and the cycle Ti−1 is a cycle just before the cycle Ti. A differential circuit 33 calculates an absolute value of the difference between the output interval data. A comparator 34 compares the obtained differences with a predetermined value. In this example, the predetermined value is the value indicated by the divided time data from the divided data generator 23. FIG. 7 shows a case where the difference of the lengths between the cycle Ti−1 and the cycle Ti is larger than the divided time data of Ti−1/4 (when n=2) which is obtained by dividing the interval data of the cycle Ti−1. In this case, one or more pulses lacks in the cycle Ti as indicated by P in FIG. 7. When the differences in the sequentially supplied interval data become smaller (this means that the print head unit 2 is driven at constant speed, or acceleration or deceleration is small), an OR gate 35 sets a select signal SEL at low (L) level. Then, the selector 14 as shown in FIG. 2 selects the first position information signal supplied from the interpolating circuit 12. On the contrary, when the head speed is not constant, the select signal SEL is set at high (H) level, and the selector 14 shown in FIG. 2 selects the second position information signal supplied from the edge detector 13.

Figure 8:
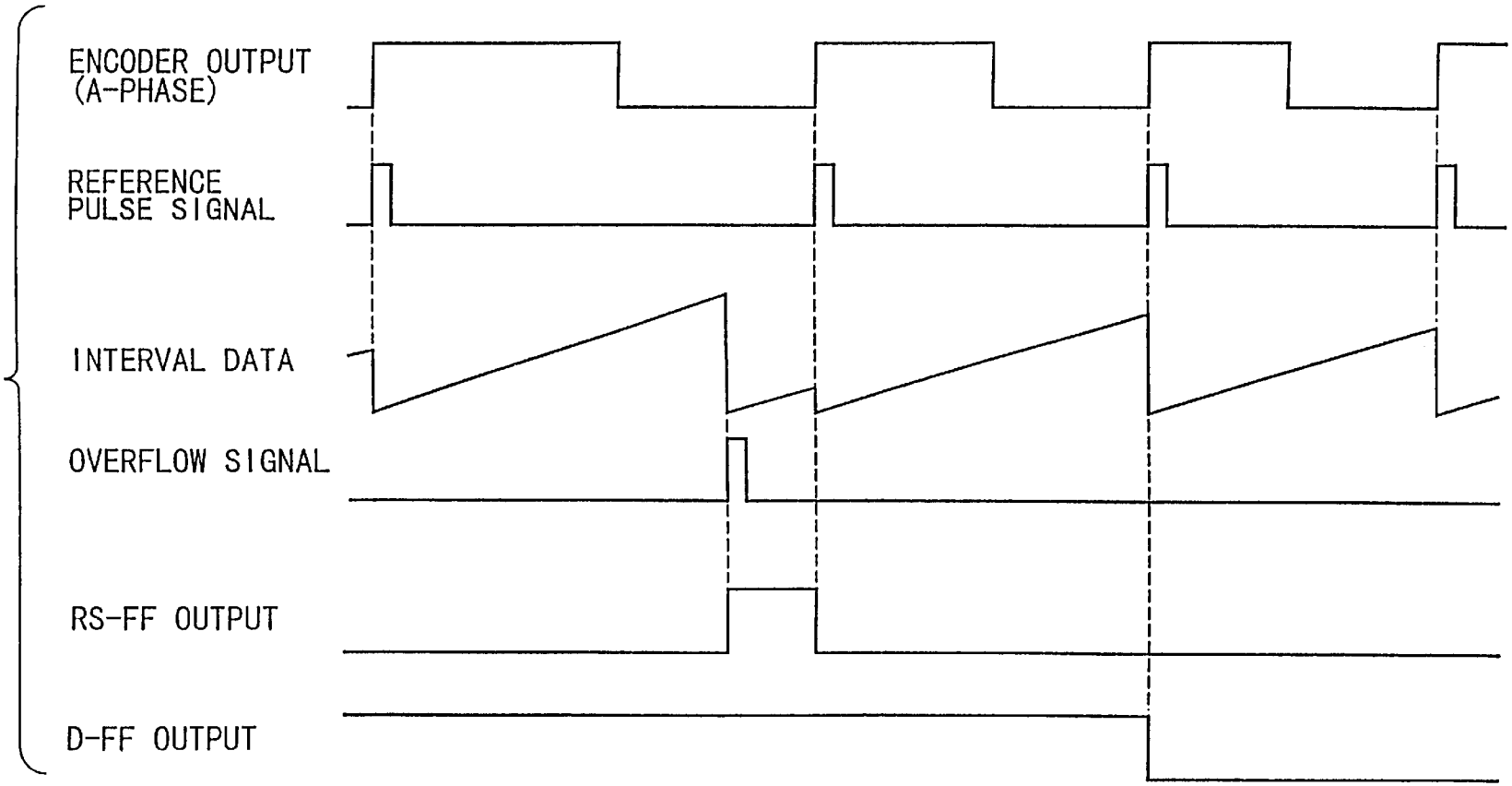
FIG. 8 is a timing chart for explaining operation of the interpolating circuit during a deceleration period of the head speed of the print head according to the embodiment.

When the count values of the first counter 22 overflow, the first counter 22 sends an overflow signal to a set input terminal S of an RS flip-flop 36 which in turn outputs the H level signal as shown in FIG. 8. A D flip-flop 37 latches the rising output of the RS flip-flop in response to the next pulse in the reference pulse signal. The output of the D flip-flop 37 is supplied to the OR gate 35 in addition to the output from the comparator 34. As a result, the select signal SEL is set at H level when the print head unit 2 is resting or is driven at a low speed, because the count values of the first counter 22 overflow. Then, the selector 14 as shown in FIG. 2 selects the second position information signal supplied from the edge detector 13.

The head driver 10 drives the print head unit 2 based on the print position information signal supplied from the selector 14 for printing image data. In the above example, the first and second position information signals have the same resolution for explanatory purpose, however, the first position information signal may have higher resolution than that of the second position information signal in a practice use. In such a case, the select signal SEL from the selector controller 5 must be supplied to the head driver 10 in order to execute head drive operation so that resultant resolution corresponds to the supplied select signal SEL. The resolution data via the resolution indicating terminal 11 must be supplied to the head driver 10 (this structure is not shown).

According to the above embodiment, the interpolating circuit 12 can detect printing position not only when the head speed is constant (printing period), but also when the print head is driven at accelerating or decelerating speed (non-printing period) if predetermined conditions are satisfied.

Figure 9:
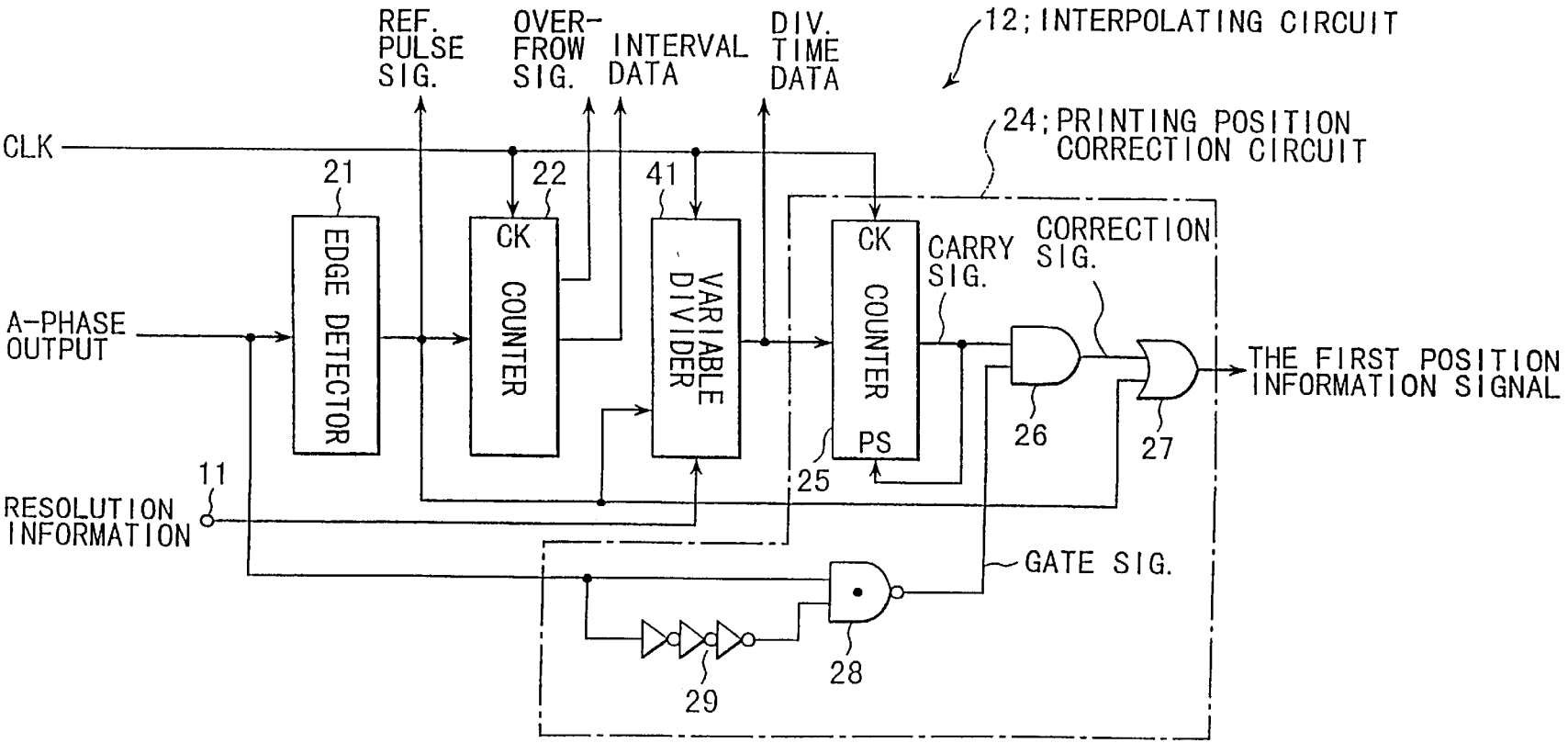
FIG. 9 is a block diagram showing the structure of an interpolating circuit according to another embodiment of the present invention.
Figure 10:
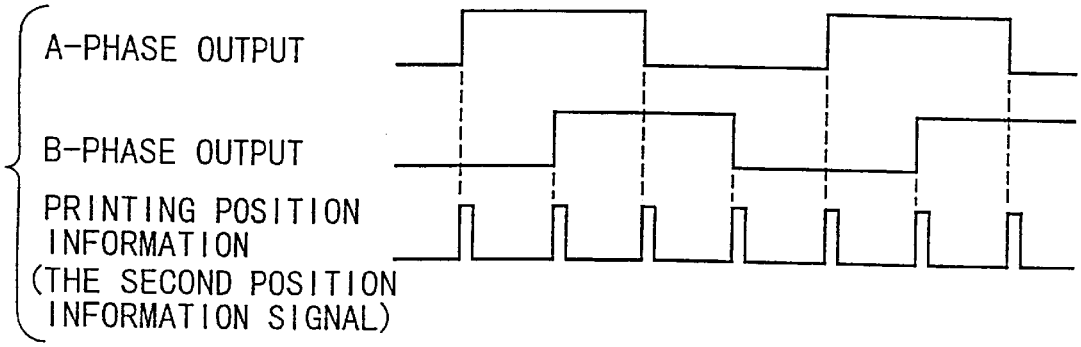
FIG. 10 is a timing chart for explaining a conventional method of generating a printing position information signal to realize high resolution printing.
Figure 11:
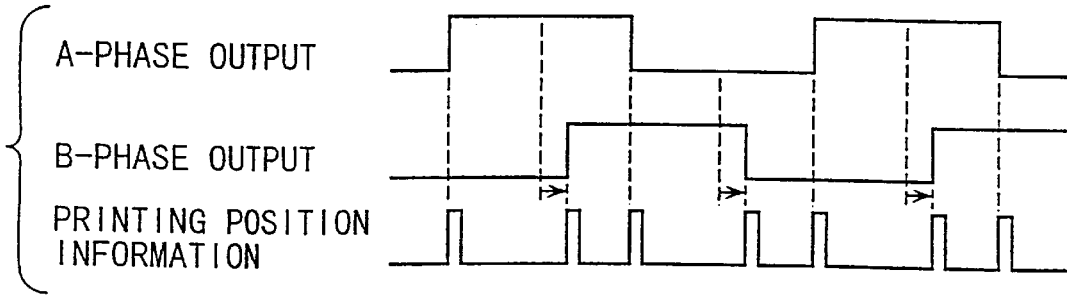
FIG. 11 is a timing chart for explaining problems of the conventional method of generating a printing position information signal.

The present invention is not limited to the above described embodiment. For example, the divided time data may be generated by another way. That is, a variable divider 41 may be provided instead of the divide time generator 23 as shown in FIG. 9. In this case, the variable divider 41 frequency-divides the clock signal CLK by arbitrary dividing ratio based on the resolution information to generate the divided time data, unlike the above embodiment wherein the divided time data generator 23 generates the divided time data to be supplied to the second counter 25 by dividing the interval data measured by the first counter 22 of the interpolating circuit 12. This method has an advantage of greater resolution range. For example, the variable divider 41 has a circuit which allows four pulses of five pulses in the clock signal CLK to pass, and then an output signal of the circuit is divided so as to have pulses as twice as many as the original pulses. As a result, a resultant signal has the pulses as five times as many as the original pulses.

A method of detecting the head speed or acceleration of the print head unit 2 is not limited to the above embodiment wherein the head speed is detected based on the outputs of the interpolating circuit 12. The detection may be executed by an arbitrary method. In the above embodiment, the select control circuit for controlling the selector has the hardware structure, however, such selecting function may be executed by software.

The ink-jet plotter is exemplified in the above embodiment. This invention may be adopted in a printing apparatus employing the other printing method such as thermal printing.

According to the above description, the present invention provides a printing apparatus which has excellent controllability of print position even when the print head is driven at accelerating or decelerating speed, while keeping the apparatus's advantages of fine and high resolution printing quality, because a suitable interpolating method is selectable in accordance with the head speed or acceleration of the print head.

What is claimed is:

1. A printing apparatus comprising:

a print head which is driven along a guide;

a linear encoder comprising a scale which is in parallel to said guide, and a sensor which is driven along said scale together with said print head to read said scale and output a plurality of encoder output signals having different phases;

position information signal generating means for generating a print position information signal indicating position of said print head by processing said encoder output signals; and head drive means for driving said print head based on the position information signal output from said position information signal generating means and image data, wherein said position information signal generating means comprises:

interpolating means for generating a reference pulse signal by detecting pulse edges in at least one of the encoder output signals output from said linear encoder, for obtaining interval data by measuring time periods between pulses in the reference pulse signal, for obtaining divided time data by dividing the interval data by a predetermined number, for generating a correction signal at each end of the time periods represented by the divided time data, and for outputting a first position information signal based on the correction signal and the reference pulse signal;

an edge detector for outputting a second position information signal which is obtained by detecting pulse edges in the plurality of encoder output signals, generating pulses in response to the edge detection, and synthesizing the detection pulses;

selecting means for selecting one of the first position information signal from said interpolating means and the second position information signal from said edge detector; and select control means for controlling said selecting means to select the first position information signal from said interpolating means as the print position information signal when said print head is driven at a speed which is higher than a speed control limit and to select the second position information signal from said edge detector as the print position information signal when said print head is driven at a speed which is lower than the speed control limit.

2. The printing apparatus according to claim 1, wherein said select control means controls said selecting means to select the first position signal as the print position signal when each of the differences between successive interval data is smaller than the divided time data, and to select the second position information signal as the print position information signal when each of the differences between successive interval data segments is equal to or larger than the divided time data.

3. The printing apparatus according to claim 1, wherein said select control means controls said selecting means to select the first position information signal as the print position information signal when said print head is driven at a constant speed and to select the second position information signal as the print position information signal when said print head is driven at an accelerating or decelerating speed.

4. The printing apparatus according to claim 1, wherein said select control means controls said selecting means to select the first position information signal as the print position information signal when said print head is driven at a constant speed while said print head is in a printing period, to select the first position information signal as the print position information signal when each of the differences between successive interval data is smaller than the divided time data while said print head is in a non-printing period, and to select the second position information signal as the print position information signal when each of the differences between successive interval data is equal to or larger than the divided time data while said print head is in non-printing period.

5. A printing apparatus comprising:

a print head which is driven along a guide;

a linear encoder comprising a scale which is in parallel to said guide, and a sensor which is driven along said scale together with said print head to read said scale and output a plurality of encoder output signals having different phases;

position information signal generating means for generating a print position information signal indicating position of said print head by processing said encoder output signals; and head drive means for driving said print head based on the position information signal output from said position information signal generating means and image data, wherein said position information signal generating means comprises:

interpolating means for generating a reference pulse signal by detecting pulse edges in at least one of the encoder output signals output from said linear encoder, for obtaining interval data by measuring time periods between pulses in the reference pulse signal, for obtaining divided time data by dividing the interval data by a predetermined number, for generating a correction signal at each end of the time periods represented by the divided time data, and for outputting a first position information signal based on the correction signal and the reference pulse signal;

an edge detector for outputting a second position information signal which is obtained by detecting pulse edges in the plurality of encoder output signals, generating pulses in response to the edge detection, and synthesizing the detection pulses;

selecting means for selecting one of the first position information signal from said interpolating means and the second position information signal from said edge detector; and select control means for controlling said selecting means to select the first position information signal from said interpolating means as the print position information signal when an absolute value of acceleration of said print head is equal to or smaller than an acceleration control limit, and to select the second position information signal from said edge detector as the print position information signal when the absolute value of acceleration of said print head is larger than the acceleration control limit.

6. The printing apparatus according to claim 5, wherein said select control means controls said selecting means to select the first position information signal as the print position information signal when each of the differences between successive interval data segments is smaller than the divided time data, and to select the second position information signal as the print position information signal when each of the differences between successive interval data segments is equal to or larger than the divided time data.

7. The printing apparatus according to claim 5, wherein said select control means controls said selecting means to select the first position information signal as the print position information signal when said print head is driven at a constant speed, and to select the second position information signal as the print position information signal when said print head is driven at an accelerating or decelerating speed.

8. The printing apparatus according to claim 5, wherein said select control means controls said selecting means to select the first position information signal as the print position information signal when said print head is driven at a constant speed while said print head is in a printing period, to select the first position information signal as the print position information signal when each of the differences between successive interval data is smaller than the divided time data while said print head is in non-printing period, and to select the second position information signal as the print position information signal when each of the differences between successive interval data is equal to or larger than the divided time data while said print head is in non-printing period.

* * * * *